US008827272B1

(12) United States Patent
Carney, Jr. et al.

(10) Patent No.: US 8,827,272 B1
(45) Date of Patent: Sep. 9, 2014

(54) RECREATIONAL DEVICE

(71) Applicants: Andrew J. Carney, Jr., McKinney, TX (US); Jeffery M. Gallagher, Princeton, TX (US)

(72) Inventors: Andrew J. Carney, Jr., McKinney, TX (US); Jeffery M. Gallagher, Princeton, TX (US)

( * ) Notice: Subject to any disclaimer, the term of this patent is extended or adjusted under 35 U.S.C. 154(b) by 46 days.

(21) Appl. No.: 13/795,188

(22) Filed: Mar. 12, 2013

(51) Int. Cl.
*A63B 63/00* (2006.01)
*A63G 31/00* (2006.01)

(52) U.S. Cl.
CPC ..... *A63G 31/007* (2013.01)
USPC ..... 273/384

(58) Field of Classification Search
USPC ..... 273/383–392
See application file for complete search history.

(56) References Cited

U.S. PATENT DOCUMENTS 988,334 A * 4/1911 Hammett ..... 273/371
1,021,019 A 3/1912 Van Kannel
1,593,267 A * 7/1926 Myre ..... 273/375
1,644,891 A * 10/1927 Myre ..... 74/2
1,811,092 A * 6/1931 Myre ..... 273/375
1,991,610 A * 2/1935 Gaus ..... 273/384
2,202,738 A 5/1940 Keller
4,093,228 A 6/1978 Pierce
4,466,616 A 8/1984 Griego
4,943,064 A 7/1990 Smith, Jr.
5,087,054 A 2/1992 O'Neil
6,102,404 A * 8/2000 Barker ..... 273/385
6,666,456 B1 12/2003 Swankie

* cited by examiner

*Primary Examiner* — Mark Graham
(74) *Attorney, Agent, or Firm* — Hahn, Loeser & Parks LLP; Rex W. Miller, II

(57) ABSTRACT

A recreational device is disclosed that includes a frame, a seat having a user supporting seat portion adapted to support a user to be displaced from the seat upon activation of a target mechanism, with the seat configured to return to a first position under the effect of gravity after the user is displaced from the seat. Embodiments of the device include a seat support configured to maintain the seat in the first position to release the seat allowing the seat to pivot upon activation of the target mechanism to displace the user from the seat The device also includes a target mechanism connected to the seat support by a force transition system configured to transfer a force applied to the target mechanism to the seat support causing the seat support to release the seat and displace a user from the seat.

19 Claims, 15 Drawing Sheets

RECREATIONAL DEVICE

BACKGROUND

The present disclosure is related to a recreational device, and more specifically, to a recreational device for displacing a user into a swimming pool or other body of water.

Traditional dunk tank devices with a target which when struck by an object cause the user to be dumped into a container with water are expensive and not generally available for regular consumers. These devices have traditionally been used by carnivals and circuses and are not made for home use. In addition, traditional dunk tanks are large, involve complicated construction, and require special assembly of both the tank and chair mechanisms. Furthermore, these devices may require invasive and complex installation.

Therefore, there continues to be a need for a recreational device that involves a target which when struck by an object cause the user to be dumped into a container with water that is economical, available for home use, and easy to install.

SUMMARY

A recreational device is presently disclosed. The recreational device may have a frame. The recreational device may also have a seat secured to the frame by a seat pivot joint, the seat having a first end, a second end opposite the first end, and a user supporting seat portion adapted to support a user to be displaced from the seat upon activation of a target mechanism, wherein the user supporting seat portion is positioned between the seat pivot joint and the first end. The seat may further have a center of mass located between the seat pivot joint and the second end such that the seat is configured to return to a first position under the effect of gravity after the user is displaced from the seat. Alternatively, the recreational device may have a reset spring operatively connected to the seat and to the frame such that the reset spring applies a force to the seat to return the seat to the first position after the user is displaced from the seat.

The recreational device may also have a seat support configured to maintain the seat in the first position when a user occupies the user supporting seat portion and configured to release the seat allowing the seat to pivot upon activation of the target mechanism to displace the user from the seat, wherein the seat support comprises: a first seat support member pivotally secured to the frame, and a second seat support member pivotally secured to the seat and to the first seat support member by a support pivot. The support pivot may define a seat support angle between the first seat support member and the second seat support member, and wherein the seat support maintains the seat in the first position when the angle is less than or equal to 180 degrees, and releases the seat from the first position when the angle is greater than 180 degrees.

The recreational device may also include a target mechanism connected to the seat support by a force transition system configured to transfer a force applied to the target mechanism to the seat support causing the support pivot to rotate thereby increasing the seat support angle to greater than 180 degrees and causing the seat support to release the seat and displace a user from the seat.

BRIEF DESCRIPTION OF THE DRAWINGS

Reference is made to the accompanying drawings in which particular embodiments of the invention are illustrated as described in more detail in the description below, in which.

DETAILED DESCRIPTION OF THE DRAWINGS

Figure 1:
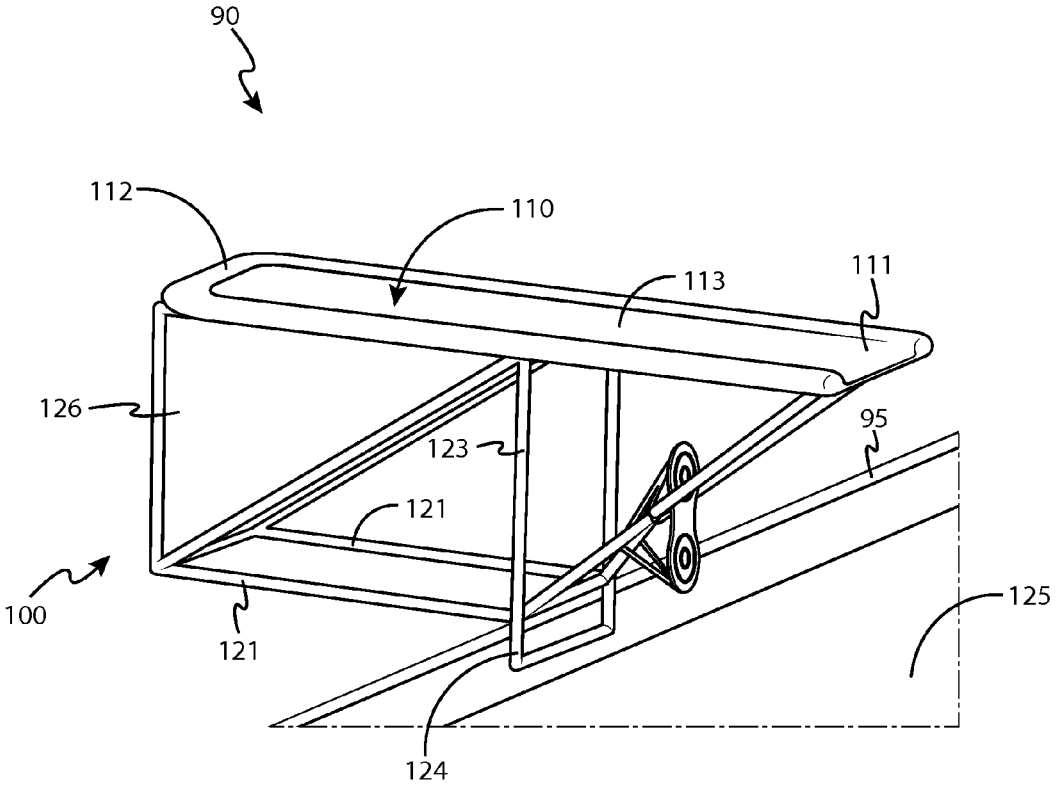
FIG. 1 is a perspective view of a recreational device in a first position.
Figure 2:
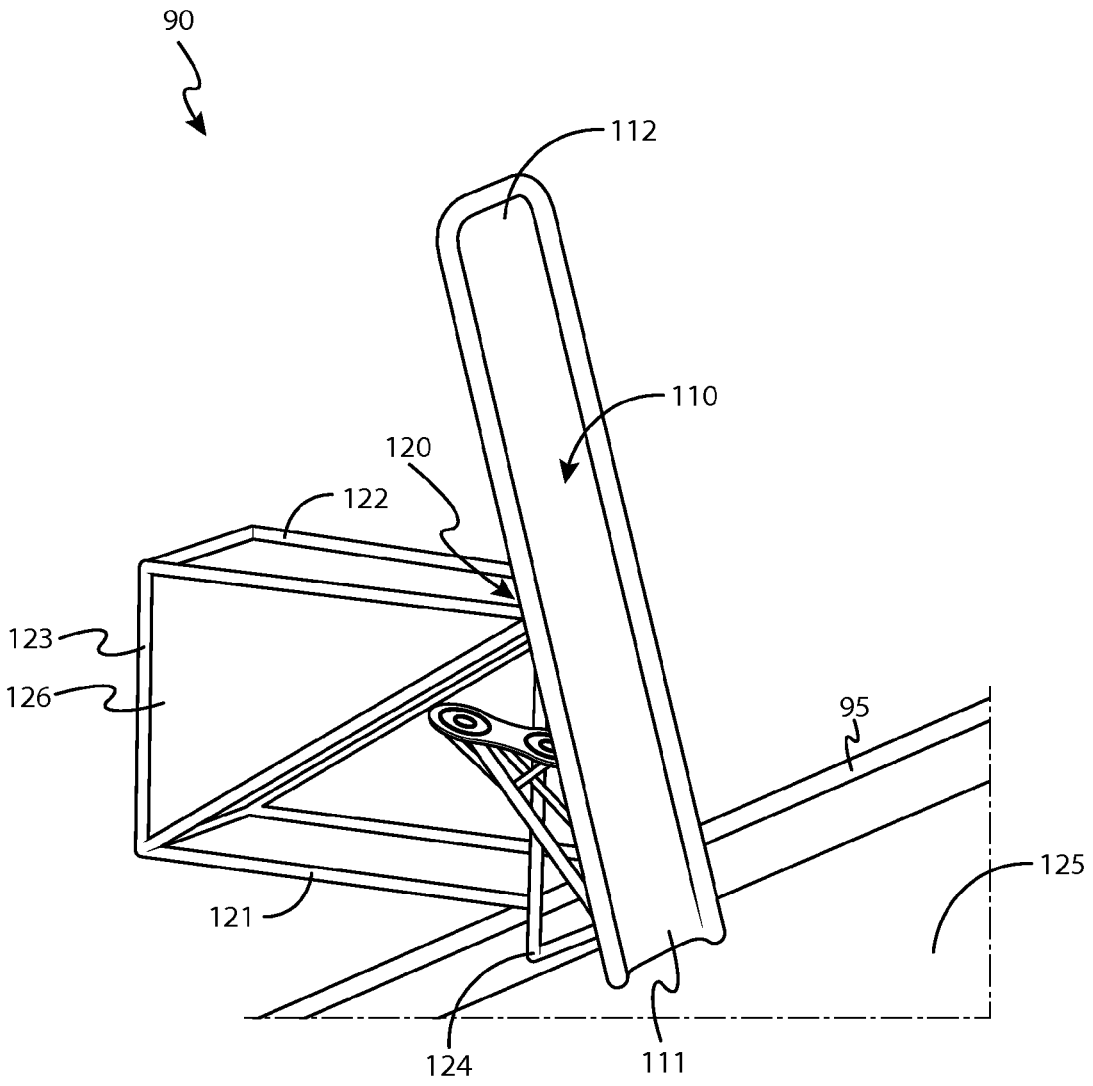
FIG. 2 is a perspective view of a recreational device in a second position.

Referring generally to FIGS. 1-17, embodiments of a recreational device are disclosed. The recreational device 90 includes a frame 100 and a seat 110. The seat 110 is secured to the frame 100 by a seat pivot joint 120. The seat 110 has a first end 111, a second end 112 opposite to the first end 111, and a user supporting seat portion 113 adapted to support a user. The user supporting seat portion 113 is positioned between the seat pivot joint 120 and the first end 111 of the seat and may extend to and include the first end of the seat. The recreational device 90 also includes a seat support 130 and a target mechanism 140. Referring to FIG. 1, the recreational device 90 is illustrated with the seat 110 in a first position such that a user occupying the user supporting seat portion 113 is suspended above a pool 125. Upon activation of a target mechanism, the seat 110 pivots towards a second position as illustrated in FIG. 2, displacing the user from the seat 110 into the pool 125. The seat 110 is then returned to the first position so that the recreational device is ready to be used again. In an embodiment, the seat 110 has a center of mass located between the seat pivot joint 120 and the second end 112 such that the seat is configured to return to a first position under the effect of gravity after the user is displaced from the seat 110. For illustration, the recreational device presently disclosed is illustrated for use with a pool, such as an in-ground or above-ground pool, however the recreational device may also be used in other contexts including tanks or lakes as desired by the user.

As further illustrated in FIG. 1, the frame 100 may have a positioning component 124 extending below a base portion of the frame 100 to position the user supporting seat portion 113 over an edge 95 of the pool 125 or similar structure for receiving the user displaced from the seat. In an embodiment, the frame 100 includes a counterweight compartment 126 extending to an end of the frame 100 opposite the seat pivot joint 120. The counterweight compartment 126 is adapted to hold a ballast material sufficient to maintain the recreational device 90 in an upright position when a user occupies the user supporting seat portion 113 in the first position as illustrated in FIG. 1. In embodiments, the ballast material may be water, sand or other material suitable for use in a recreational device.

In yet other embodiments, the frame 100 may be anchored to the ground or other structure adjacent a pool to prevent the recreational device from being dislodged during use. In yet other embodiments, the positioning component 124 is configured to assist in maintaining the recreational device 90 in an upright position when a user occupies the user supporting seat portion 113.

As shown in FIGS. 1 and 2, the frame 100 may be a tubular frame having a rectangular base portion 121 and a rectangular top portion 122 with the base portion 121 connected to the top portion 122 by vertical supports 123 disposed at each corner of the base portion 121. The tubular frame may be construed with sections of plastic tube to form the frame structure with sufficient strength to support a user on the seat 110 during use of the recreational device. In one embodiment, the frame is constructed of hollow tubes having a substantially circular cross-section, however other materials and configurations are also contemplated. In various embodiments, the frame may be constructed of wood or metal, such as a stainless steel, suitable for use in a recreational device in an aquatic environment. As illustrated, the frame may have a substantially rectangular footprint, however other shapes and configurations, such as triangular or oval, may also be used to provide sufficient support for the recreational device.

Figure 3:
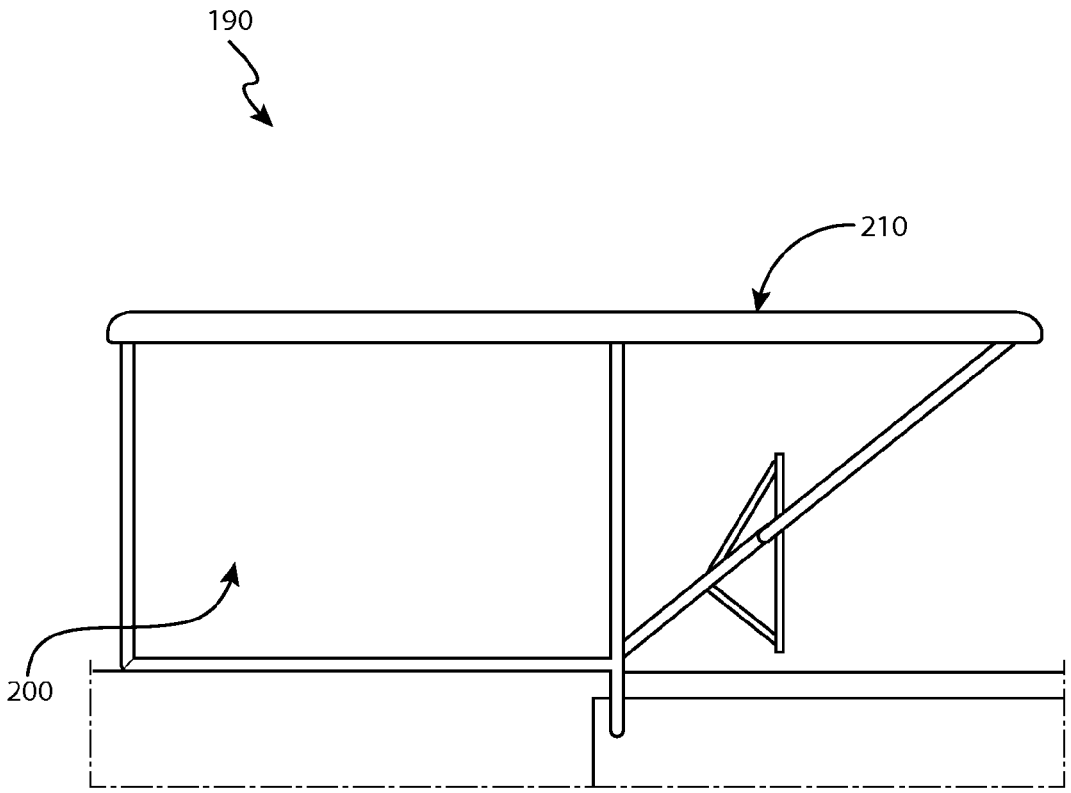
FIG. 3 is a side view of a molded frame.

Referring now to FIG. 3, in another embodiment, a recreational device 190 has a molded frame 200. The molded frame may be formed of one or more sections of contiguous material molded into the desired shape to provide structural support for the seat 210 of the recreational device. The molded frame 200 may include a separate counterweight compartment. Alternatively, the molded frame 200 may be configured to receive a ballast material within the molded frame. In yet another embodiment, the frame may be constructed of materials sufficiently dense so as obviate the need for a separate counterweight.

Figure 4:
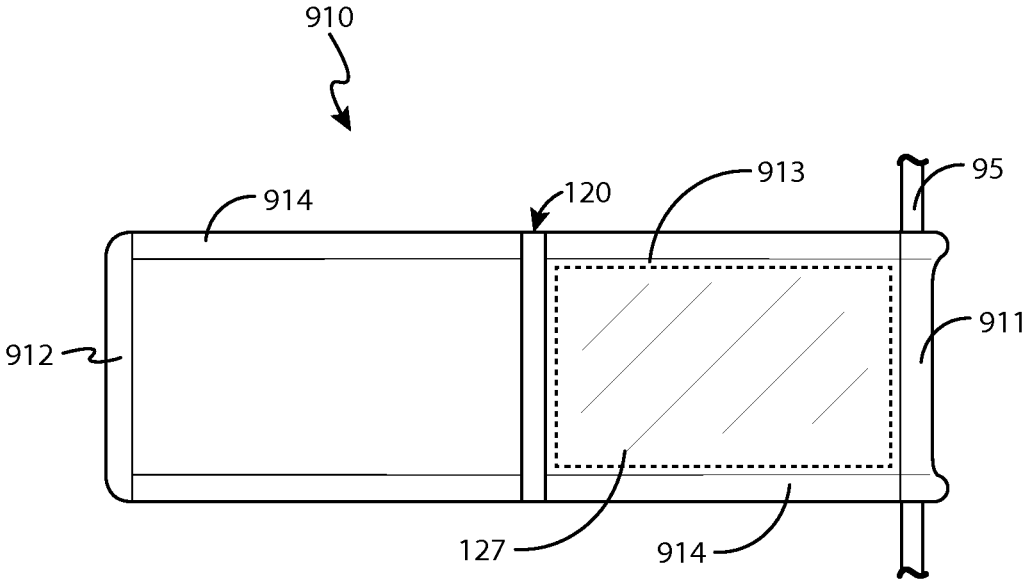
FIG. 4 is a top view of a seat.
Figure 5:
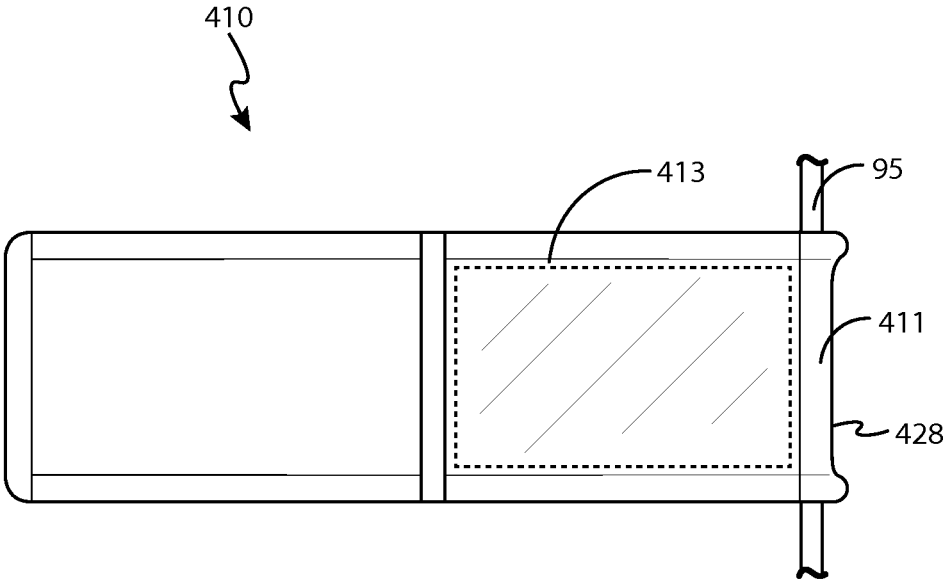
FIG. 5 is a top view of a seat with a radiused portion.
Figure 6:
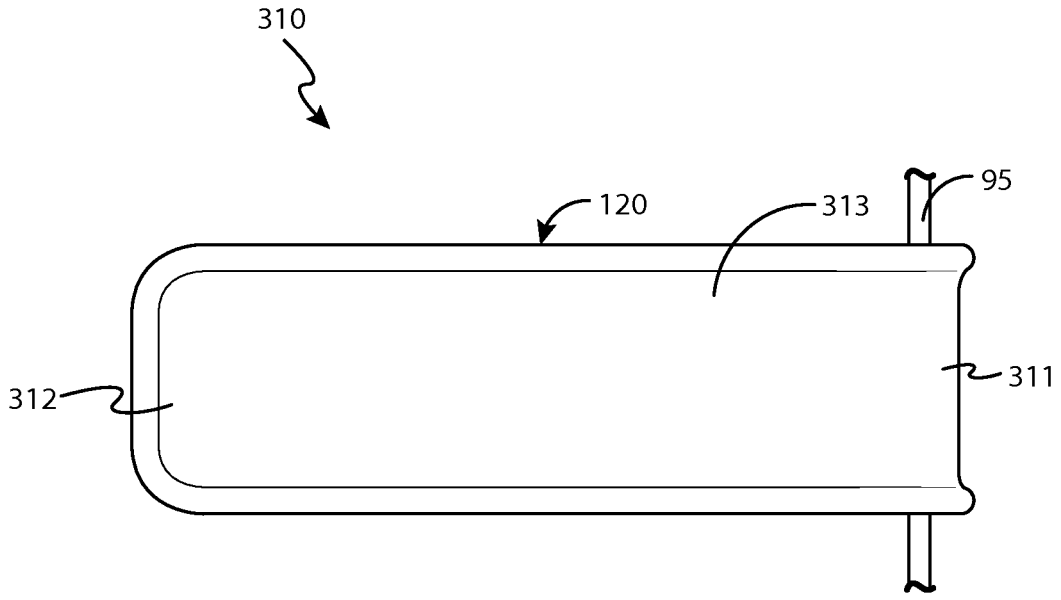
FIG. 6 is a top view of a plank.

Referring now to FIGS. 4-6, embodiments of a seat for the recreational device are illustrated. The recreational device includes a seat secured to a frame by a seat pivot joint. In one embodiment, illustrated in FIG. 4, the seat 910 includes a first end 911 and a second end 912 opposite the first end 911. The seat 910 includes a seat frame 914 extending between the first end 911 and the second 912. The seat frame 914 connects to the frame of the recreational device at the seat pivot joint 120. When the seat is in the first position, such as when a user is not occupying the seat, the seat frame 914 may be supported on at least a portion of the frame of the recreational device. The seat 910 includes a user supporting seat portion 913 adapted to support a user to be displaced from the seat 910 upon activation of a target mechanism. The user supporting seat portion 913 is positioned between the seat pivot joint 120 and the first end 911 of the seat. In one embodiment, the user supporting seat portion 913 is a pad 127 secured to the seat frame 914 between the seat pivot joint 120 and the first end 911 of the seat. The pad 127 may be secured to opposite sides of the frame to form the user supporting portion. The pad 127 may be cushioned or may not be cushioned. In embodiments, the pad 127 may be formed of water resistant material. In addition, the pad 127 may be formed of material having a low coefficient of friction, such as smooth plastic or nylon, to facilitate a user sliding off the pad over the first end 911 and into a pool. In an embodiment, the seat frame 914 is substantially U-shaped with the first end 911 being open and the pad 127 forming a sling-type seat that extends to the first end of the seat. In this manner, when the seat 910 pivots towards the second position the user may slide off the pad 127 past the first end 911 and into a pool without contacting the seat frame. The U-shaped seat frame may further comprise a cushioned portion secured to the first end of the seat.

Referring now to FIG. 5, in another example, the first end 411 of the seat 410 may comprise a radiused portion 428 to enable a user to be displaced from the user supporting seat portion 413 by sliding over the radiused portion 428 of the first end 411 of the seat. A radiused portion may be included with various embodiments of a seat to provide a transition from a generally horizontal user supporting portion to the first end of the seat to reduce any discomfort that may be associated with sliding off the first end of the seat.

Referring now to FIG. 6, another embodiment of a seat for the recreational device is illustrated. In an embodiment, the seat is a plank 310 configured to pivot on the seat pivot joint 120. The plank 310 is a generally rectangular structure having a first end 311 and a second end 312. In embodiments, the plank 310 is formed of a continuous piece of plastic or metal, such as by molding or stamping. The plank 310 may have contoured edges to facilitate use in a recreational setting. The plank 310 has user supporting portion 313 positioned between the seat pivot joint 120 and the first end 311. In one embodiment, the user supporting portion 313 is a contoured portion of the plank 310 configured to accommodate a user sitting upon the plank 310 in the desired location. In another embodiment, the user supporting portion 310 is a portion of the plank 310 near the first end 311 of the seat on which the user sits when using the recreational device. The user supporting portion 313 may be designated either explicitly or implicitly and the user supporting portion may be continuous with the remainder of the plank extending towards the seat pivot joint 120 and the second end 312. In another embodiment, the first end of the plank may comprise a radiused portion to enable a user to be displaced from the user supporting seat portion by sliding over the radiused portion of the first end of the plank. A radiused portion may be included with various embodiments of a plank to provide a transition from a generally horizontal user supporting portion to the first end of the plank to reduce any discomfort that may be associated with sliding off the first end of the plank.

Figure 7:
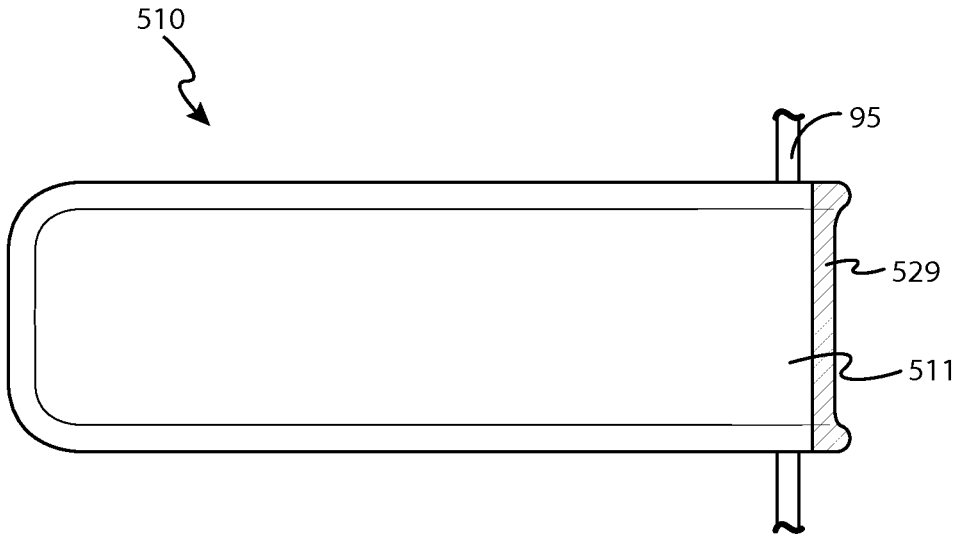
FIG. 7 is a top view of a plank with a cushioned portion.

Referring now to FIG. 7, another embodiment of a seat for the recreational device is illustrated. In an embodiment, the seat is a plank 510 which includes a cushioned portion 529. The cushioned portion 529 may be secured to the first end 511 of the plank. The cushioned portion 529, similar to a radiused portion, may facilitate the transition of the user from the user supporting portion over the first end of the seat. In addition, the cushioned portion 529 may protect against incidental contact between the user falling to the pool and the seat as the seat begins to return to the first position.

Figure 8:
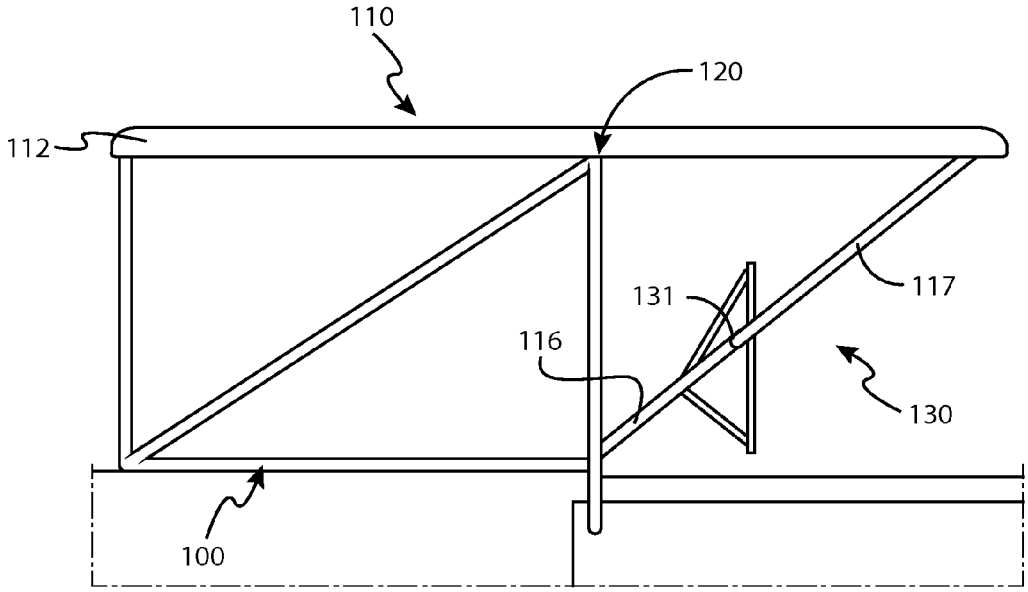
FIG. 8 is a side view of a seat support.
Figure 9:
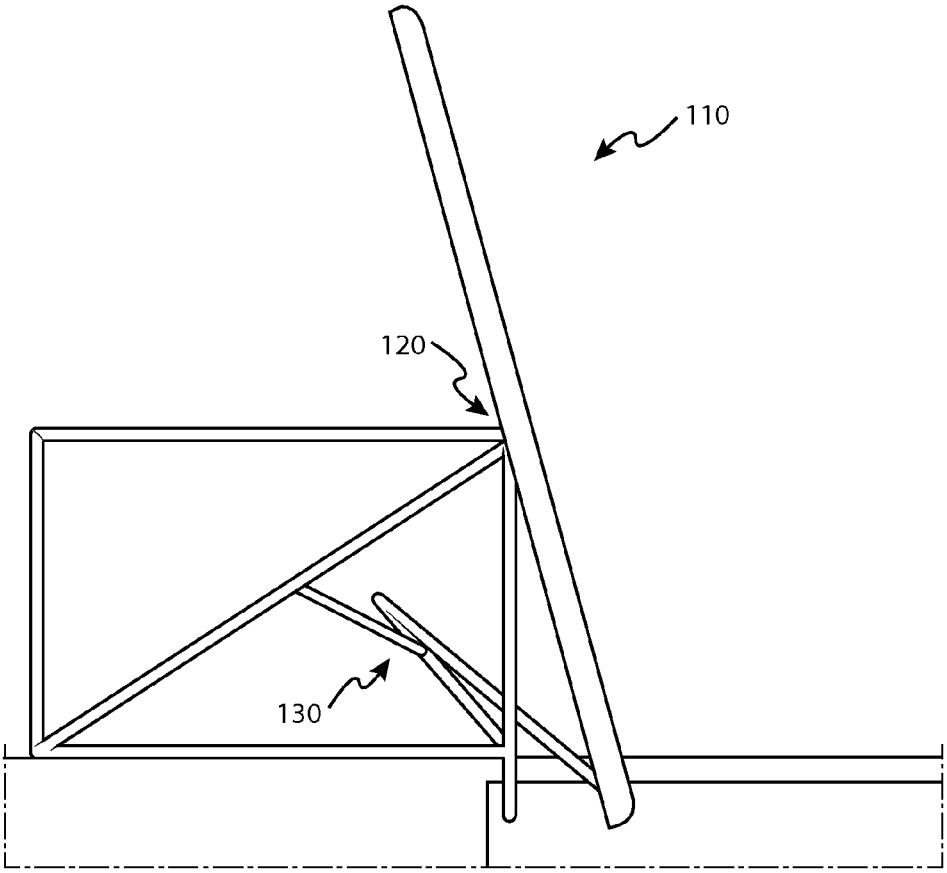
FIG. 9 is a side view of a seat support.

Referring now to FIGS. 8-9, the recreational device is illustrated having a seat 110 and a seat support 130. The seat support 130 is configured to maintain the seat 110 in the first position when a user occupies the user supporting seat portion, and is configured to release the seat 110 allowing the seat to pivot on the seat pivot 120 upon activation of a target mechanism to displace the user from the seat. In one embodiment, the seat support 130 includes a first seat support member 116 pivotally secured to the frame 100, and a second seat support member 117 pivotally secured to the seat and to the first seat support member 116 by a support pivot 131. The first seat support member and the second seat support member may be secured to the frame and seat, respectively, by pivoting joints allowing sufficient rotation for operation of the recreational device.

Referring to FIG. 8, the recreational device 90 is illustrated with the seat in the first position. In the first position, the first seat support member 116 and the second seat support member 117 are configured to bear the weight of a user positioned on the user supporting portion of the seat. Upon activation of a target mechanism (described below), the support pivot 131 rotates such that the first seat support member 116 and the second seat support member 117 no longer support the weight of the user on the seat. As shown in FIG. 9, when the seat support 130 no longer supports the weight of the user on the seat 110, the seat pivots on the seat pivot 120 towards the second position and the user is displaced into the pool.

After the user is displaced from the seat, the seat returns to the first position to be used again. In an embodiment, the seat 110 has a center of mass located between the seat pivot joint 120 and the second end 112 such that the seat 110 is configured to return to the first position, such as shown in FIG. 8, under the effect of gravity after the user is displaced from the seat 110. In this manner, the recreational device automatically resets the seat to the first position without the need for user intervention or complex mechanical systems such as those employed in the prior art. The automatic reset of the seat to the first position reduces the requirement on the users of the recreational device and increases the suitability of device for the home and consumer market. Positioning the center of mass of the seat between the seat pivot 120 and the second end 112 may be accomplished in a variety of methods, including selecting the location of the seat pivot 120 and/or weighting the second end of the seat. In one embodiment, the seat frame, such as illustrated in FIG. 5, may be weighted at or near the second end. In another example, for a plank type seat, such as illustrated in FIG. 6, the recreational device may be constructed to position the seat pivot closer to the first end of the seat thereby positioning the center of mass of the seat between the seat pivot and the second end. Alternatively or in addition, a counterweight may be secured to the plank near the second end to achieve the desired relationship between the center of mass of the seat and the seat pivot joint. The seat may be constructed to position the center of mass in order to affect the rate of rotation of the seat, particularly as the seat returns to the first position after the user is displaced. By positioning the center of mass closer to the second end of the seat, the rate of rotation of the seat may be increased. Conversely, if the center of mass is positioned closer to the seat pivot, the rate of rotation may be reduced resulting in a slower return of the seat. In one embodiment, the seat includes a moveable counterweight the position of which may be adjusted in a range between the seat pivot joint and the second end of the seat. By moving the counterweight the rate of rotation of the seat may be adjusted as desired by the user.

Figure 10:
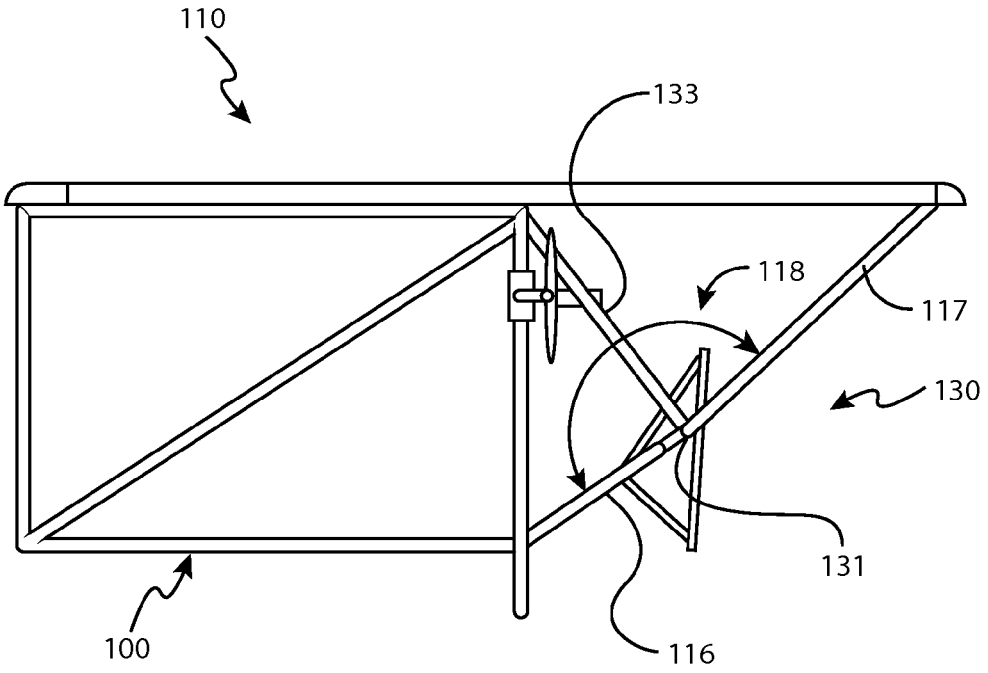
FIG. 10 is a side view of a seat support.

Referring now to FIG. 10, in an embodiment, the seat support 130 has a support pivot 131 that defines a seat support angle 118. As shown, the seat support angle 118 is defined by the first seat support member 116 and the second seat support member 117. In this embodiment, the seat support 130 maintains the seat 110 in the first position when the seat support angle is less than or equal to 180 degrees, and releases the seat 110 from the first position when the angle is greater than 180 degrees. When a user occupies the user supporting seat portion and the seat support angle is increased to greater than 180 degrees, the weight of the user causes the support pivot to continue rotating further increasing the seat support angle and displacing the user from the seat. Once the user is displaced, the seat returns to the first position and the support pivot rotates back into position to support the seat with the seat support angle equal to or less than 180 degrees. To avoid the seat support from collapsing outward, the seat support 130 includes a restraint to limit the displacement of the seat support when a user occupies the user supporting seat portion in the first position.

Referring again to FIG. 10, the recreational device may include at least one adjustable strap 133 secured to the frame 100 and to the seat support 130. The adjustable strap 133 is configured to limit or restrain the displacement of the seat support 130 and prevent the seat support 130 from collapsing outward as described above. In one embodiment, the adjustable strap 133 is secured to the frame 100 and to the support pivot 131. When a user occupies the seat in the first position the adjustable strap limits the displacement of the support pivot 131 away from the frame and maintains the seat support angle 118 greater than a determined limit angle. In embodiments, the determined limit angle corresponds to the force required to be applied to the target mechanism to displace the user from the seat 110. In embodiments, determined limit angle may be between 170 and 179 degrees and may be adjusted by adjusting the length of the adjustable strap 133. In the illustrated embodiment, shortening the length of the adjustable strap increases the limit angle thereby reducing the force required to activate the target mechanism and displace a user from the seat. In one embodiment, as shown in FIG. 10, one end of the at least one adjustable strap 133 is connected to the support pivot 131 and the other end of the at least one adjustable strap 133 is connected to the frame 100. In other embodiments, one end of the at least one adjustable strap 133 may be connected to the frame, while the other end is connected to either the first support member or the second support member. While an adjustable strap may be preferred to enable users to adjust the force required to activate the target mechanism, a fixed length strap may also be used with the recreational device.

In other embodiments, the recreational device may include a strap secured to the first support member and the second support member opposite to the seat support angle. When the seat support angle decreases to less than 180 degrees the strap prevents further rotation of the support pivot thereby causing the seat support to maintain the seat in the first position. In another embodiment, a brace may be secured to either the first support member or the second support member such that when the seat support angle decreases to less than 180 degrees the brace contacts the other of the first and second support member and prevents further rotation of the seat pivot.

Figure 11:
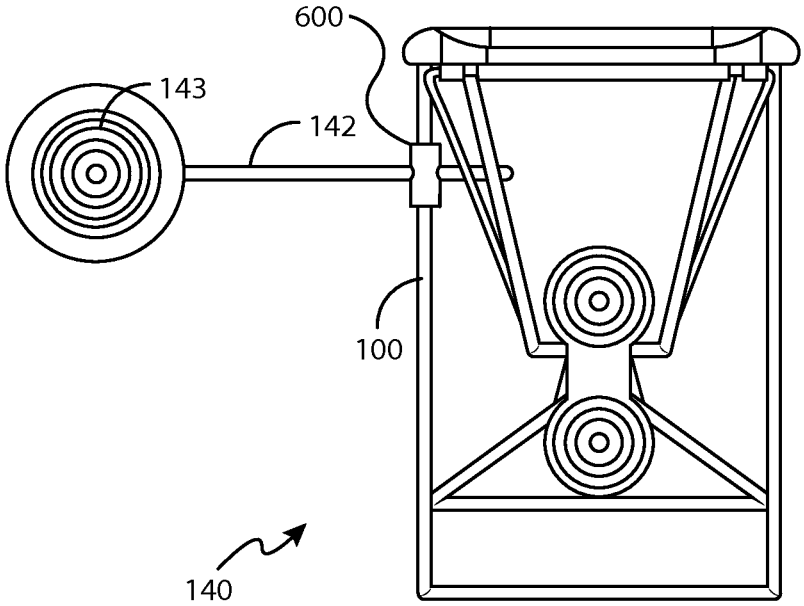
FIG. 11 is a front view of a target mechanism.

Referring now to FIGS. 10-11, the recreational device 90 includes a target mechanism 140. The target mechanism 140 may be connected to the seat support 130 by a force transition system configured to transfer a force applied to the target mechanism 140 to the seat support 130 causing the support pivot 131 to rotate thereby increasing the seat support angle 118 to greater than 180 degrees and causing the seat support 130 to release the seat 110 and displace a user from the seat 110. In one embodiment, as illustrated in FIG. 11, the target mechanism 140 includes a target arm 142 pivotally secured to the frame 100 at a pivot joint 600. The target arm 142 has a first end that extends away from the seat 110 and supports a target 143. In one embodiment, the target arm is configured to support a plurality of interchangeable targets enabling the recreational device to be customized by the user. The second end of the target arm extends under the seat and is connected to the force transition system.

Figure 12:
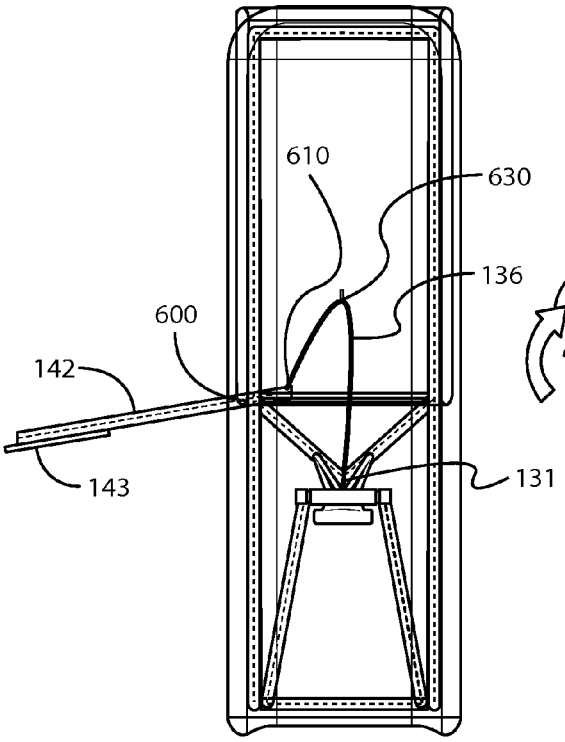
FIG. 12 is a view of a force transition system in a first position.
Figure 13:
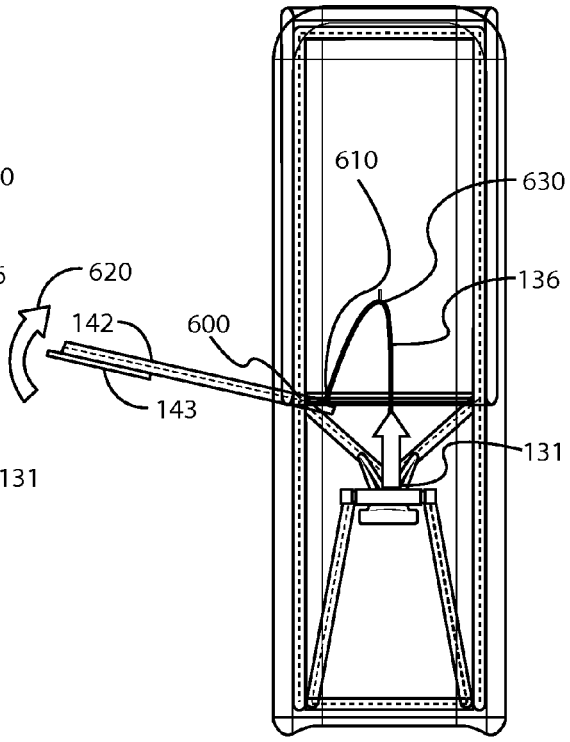
FIG. 13 is a view of the force transition system of FIG. 12 in a second position.

Referring now to FIGS. 12-13, an embodiment of a force transition system for use with the recreational device is illustrated. The target mechanism includes a target arm 142 secured to the frame of the recreational device at pivot joint 600. The recreational device includes a force transition system configured to transfer a force applied to the target mechanism to the seat support causing the support pivot to rotate thereby increasing the seat support angle to greater than 180 degrees and causing the seat support to release and displace a user from the seat. As shown in FIG. 12, in one embodiment, the force transition system includes a cable 136 with one end secured to the second end 610 of the target arm 142. The other end of the cable 136 is secured to the support pivot 131. As illustrated in FIG. 13, when a sufficient force is applied to the target 143, the target 143 is displaced (as shown by arrow 620) and the target arm 142 pivots on pivot joint 600. When the target arm 142 pivots, the second end 610 of the target arm transfers a force to the cable 136 which transfers the force to the support pivot 131. The force applied to the support pivot causes the support pivot to move (as shown by arrow 620) thereby increasing the seat support angle to greater than 180 degrees, releasing the seat from the first position and displacing the user from the seat as previously discussed. As illustrated the cable 136 may be passed through an eyelet 630 or other device to apply a force in the proper direction to the support pivot. In other embodiments, the cable 136 may be secured to other components of the seat support, such as the first support member or the second support member.

Figure 14:
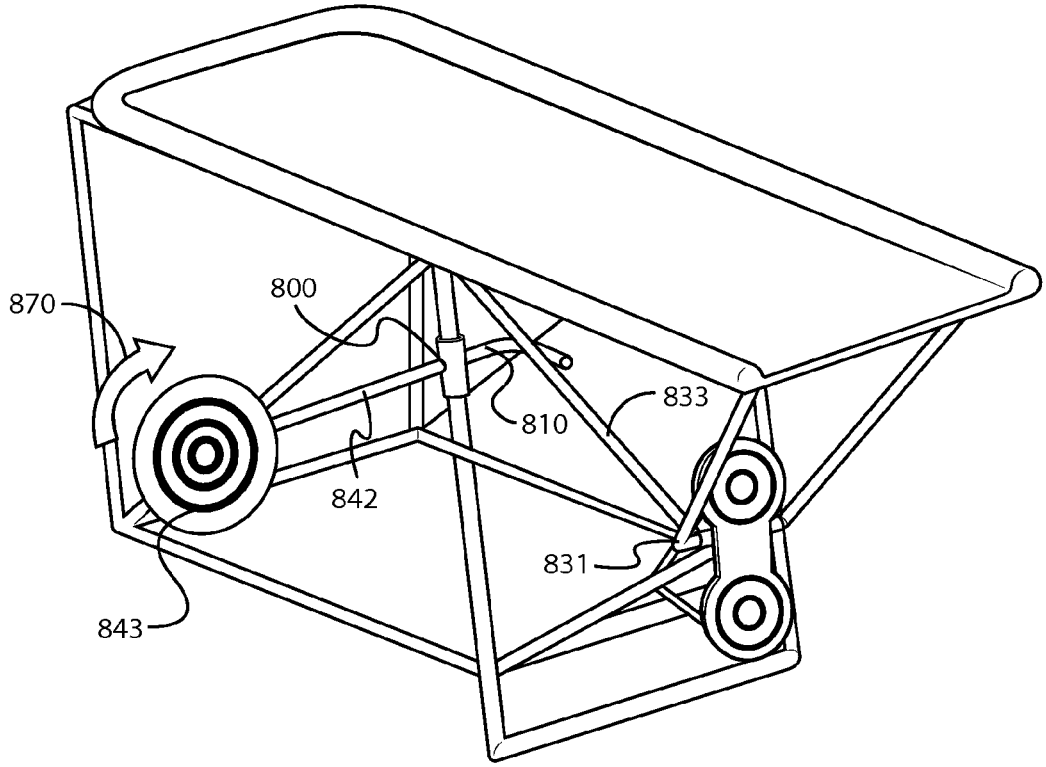
FIG. 14 is a perspective view of a recreational device with another force transition system.

Referring now to FIG. 14, another embodiment of a force transition system for use with the recreational device is illustrated in which the target mechanism includes a target arm 842 secured to the frame of the recreational device at a pivot joint 800. The target arm has a first end that extends away from the seat and supports a target 843. The second end 810 of the target arm extends under the seat and includes hooked end that forms part of the force transition system. As shown in FIG. 14, the force transition system includes a strap 833 with one end secured to the frame of the recreational device and the other end secured to the support pivot 831 or alternatively to the seat support near the support pivot 831. When sufficient force is applied to the target 843, the target is displaced (as shown by arrow 870) and the target arm 842 pivots on pivot joint 800. When the target arm pivots, the second end 810 of the target arm catches the strap 833 transferring the force to the strap which transfers the force to the seat support. The force applied to seat support causes the support 831 pivot to rotate thereby increasing the seat support angle to greater than 180 degrees, releasing the seat from the first position. In other embodiments, the second end of the target arm extends under the seat and may include a semicircle, circle, or loop shaped end portion and the strap may be passed through and/or retained in the end portion of the target arm.

Figure 15:
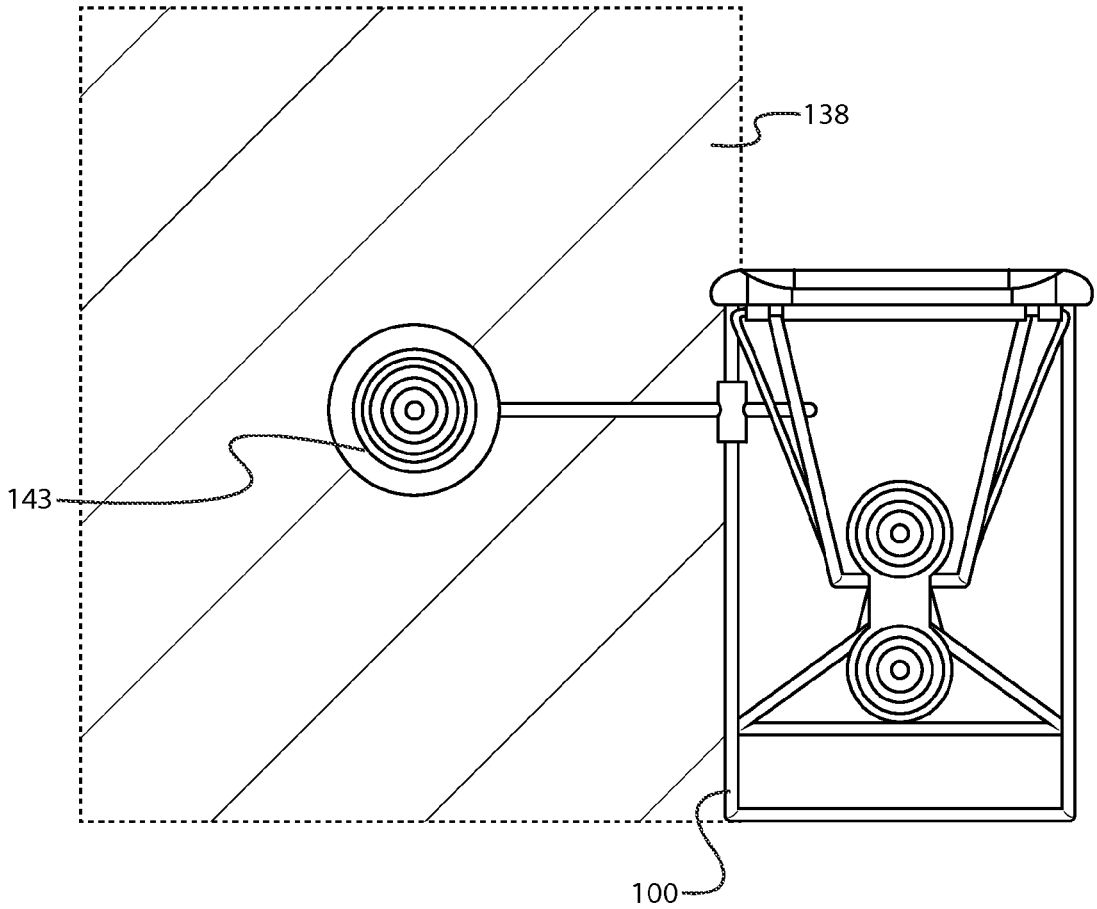
FIG. 15 is a front view of a target mechanism.

Referring now to FIG. 15, another embodiment of a recreational device is illustrated that includes a net 138. In use, objects such as balls may be thrown at the target 143 in an attempt to activate the target and displace the user from the seat. In embodiments, the recreational device may include a net 138 connected to the frame 100 such that the net 138 is positioned to receive objects thrown at the target, which miss the target. In one embodiment, the net 138 includes a mesh screen affixed to an expandable rim that may be expanded for use and collapsed when not in use.

Figure 16:
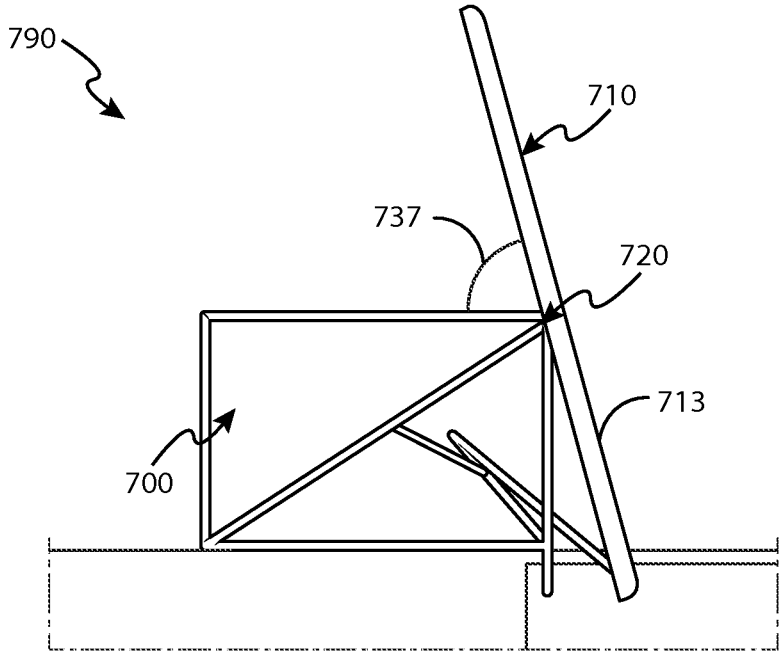
FIG. 16 is a side view of a recreational device with a reset spring.
Figure 17:
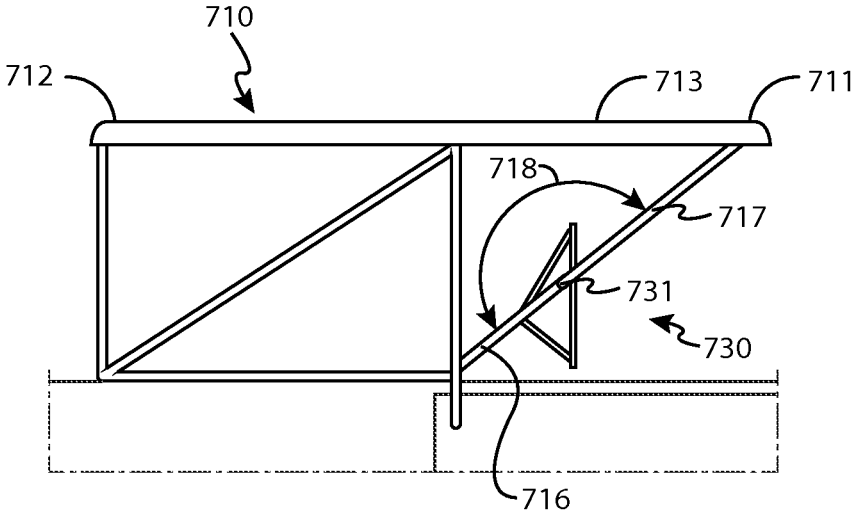
FIG. 17 is a side view of a recreational device with a reset spring.

Referring now to FIGS. 16-17, another embodiment of a recreational device is illustrated. The recreational device 790 includes a frame 700 and a seat 710 secured to the frame 700 by a seat pivot joint 720. The seat has a first end 711, a second end 712 opposite the first end 711, and a user supporting seat portion 713 adapted to support a user to be displaced from the seat 710 upon activation of a target mechanism. The user supporting seat portion 713 is positioned between the seat pivot joint 720 and the first end 711 of the seat. The recreational device 790 also includes a seat support 730 configured to maintain the seat in a first position when a user occupies the user supporting seat portion 713 and configured to release the seat allowing the seat to pivot upon activation of the target mechanism to displace the user from the seat 710. The seat support 730 includes a first seat support member 716 pivotally secured to the frame 700, and a second seat support member 717 pivotally secured to the seat 710 and to the first seat support member 716 by a support pivot 731. The support pivot 731 defines a seat support angle 718 between the first seat support member 716 and the second seat support member 717. The seat support 730 maintains the seat 710 in the first position when the angle is less than or equal to 180 degrees, and releases the seat 710 from the first position when the angle is greater than 180 degrees. In the embodiment illustrated in FIGS. 15 and 16, the recreational device 790 has a reset spring 737 with a first end operatively connected to the seat 710 between the seat pivot joint 720 and the second end 712, and a second end operatively connected to the frame 700 such that spring applies a force to the seat 710 to return the seat 710 to the first position after the user is displaced from the seat 710.

In yet another example, the recreational device includes a frame and a seat secured to the frame by a seat pivot joint. The seat has a first end, a second end opposite the first end, and a user supporting seat portion adapted to support a user to be displaced from the seat upon activation of a target mechanism. The user supporting seat portion is positioned between the seat pivot joint and the first end of the seat. The seat has a center of mass located between the seat pivot joint and the second end such that the seat is configured to return to a first position under the effect of gravity after the user is displaced from the seat. The recreational device also has a target mechanism connected to a seat support by a force transition system configured to transfer a force applied to the target mechanism to the seat support causing the seat support to release the seat and displace a user from the seat.

While certain embodiments have been described, it must be understood that various changes may be made and equivalents may be substituted without departing from the spirit or scope. In addition, many modifications may be made to adapt a particular situation or material to the teachings of the disclosure without departing from its spirit or scope.

What is claimed:

1. A recreational device comprising:

a frame, a seat secured to the frame by a seat pivot joint, the seat having a first end, a second end opposite the first end, and a user supporting seat portion adapted to support a user to be displaced from the seat upon activation of a target mechanism, wherein the user supporting seat portion is positioned between the seat pivot joint and the first end, the seat further having a center of mass located between the seat pivot joint and the second end such that the seat is configured to return to a first position under the effect of gravity after the user is displaced from the seat, a seat support configured to maintain the seat in the first position when a user occupies the user supporting seat portion and configured to release the seat allowing the seat to pivot upon activation of the target mechanism to displace the user from the seat, wherein the seat support comprises: a first seat support member pivotally secured to the frame, and a second seat support member pivotally secured to the seat and to the first seat support member by a support pivot, wherein the support pivot defines a seat support angle between the first seat support member and the second seat support member, and wherein the seat support maintains the seat in the first position when the angle is less than or equal to 180 degrees, and releases the seat from the first position when the angle is greater than 180 degrees, and a target mechanism connected to the seat support by a force transition system configured to transfer a force applied to the target mechanism to the seat support causing the support pivot to rotate thereby increasing the seat support angle to greater than 180 degrees and causing the seat support to release the seat and displace a user from the seat.

2. A recreational device comprising:

a frame, a seat secured to the frame by a seat pivot joint, the seat having a first end, a second end opposite the first end, and a user supporting seat portion adapted to support a user to be displaced from the seat upon activation of a target mechanism, wherein the user supporting seat portion is positioned between the seat pivot joint and the first end, the seat further having a center of mass located between the seat pivot joint and the second end such that the seat is configured to return to a first position under the effect of gravity after the user is displaced from the seat, and a target mechanism connected to a seat support by a force transition system, wherein the force transition system is configured to transfer a force applied to the target mechanism to the seat support causing the seat support to release the seat and displace a user from the seat.

3. The recreational device as claimed in claim 2, wherein the frame is a molded frame having a rectangular base portion.

4. The recreational device as claimed in claim 2, wherein the frame is a tubular frame having a rectangular base portion and a rectangular top portion with the base portion connected to the top portion by vertical supports disposed at each corner of the base portion.

5. The recreational device as claimed in claim 2, wherein the frame comprises a positioning component extending below a base portion of the frame to position the user supporting seat portion over an edge of a pool.

6. The recreational device as claimed in claim 2, wherein the frame further comprises a counterweight compartment extending to an end of the frame opposite the seat pivot joint, the counterweight compartment adapted to hold a ballast material sufficient to maintain the recreational device in an upright position when a user occupies the user supporting seat portion in the first position.

7. The recreational device as claimed in claim 2, wherein the user supporting seat portion comprises a pad secured to a seat frame between the seat pivot joint and the first end of the seat.

8. The recreational device as claimed in claim 2, wherein the first end of the seat comprises a radiused portion to enable a user to be displaced from the user supporting seat portion by sliding over the radiused portion of the first end of the seat.

9. The recreational device as claimed in claim 8, wherein the seat further comprises a cushioned portion secured to the first end of the seat.

10. The recreational device as claimed in claim 2, wherein the seat comprises a plank configured to pivot on the seat pivot joint, and wherein the user supporting seat portion is a portion of the plank between the seat pivot joint and the first end of the seat.

11. A recreational device comprising:

a frame, a seat secured to the frame by a seat pivot joint, the seat having a first end, a second end opposite the first end, and a user supporting seat portion adapted to support a user to be displaced from the seat upon activation of a target mechanism, wherein the user supporting seat portion is positioned between the seat pivot joint and the first end, the seat further having a center of mass located between the seat pivot joint and the second end such that the seat is configured to return to a first position under the effect of gravity after the user is displaced from the seat, and a target mechanism connected to a seat support by a force transition system configured to transfer a force applied to the target mechanism to the seat support causing a support pivot to rotate thereby increasing a seat support angle to greater than 180 degrees and causing the seat support to release the seat and displace a user from the seat.

12. The recreational device as claimed in claim 11 further comprising at least one adjustable strap secured to the frame and to the seat support, the at least one adjustable strap configured to limit the displacement of the seat support and maintain the seat support angle greater than a limit angle.

13. The recreational device as claimed in claim 12, wherein the limit angle corresponds to a force required to be applied to the target mechanism to displace the user from the seat.

14. The recreational device as claimed in claim 12, wherein a first end of the at least one adjustable strap is connected to the support pivot and a second end of the at least one adjustable strap is connected to the frame.

15. The recreational device as claimed in claim 12, wherein a first end of the at least one adjustable strap is connected to one of a first seat support member or a second seat support member, and a second end of the at least one adjustable strap is connected to the frame.

16. The recreational device as claimed in claim 11, wherein the target mechanism comprises a target arm pivotally secured to the frame, the target arm having a first end that extends away from the seat and supports a target, and having a second end that extends under the seat and is connected to the force transition system.

17. The recreational device as claimed in claim 16, wherein the force transition system comprises a cable secured to the second end of the target arm and secured to the support pivot, such that when a sufficient force is applied to the target the target arm pivots transferring a force to the support pivot increasing the seat support angle to greater than 180 degrees, releasing the seat from the first position and displacing the user from the seat.

18. The recreational device as claimed in claim 16, wherein the target arm is configured to support a plurality of interchangeable targets.

19. The recreational device as claimed in claim 11 further comprising:

at least one strap secured to the frame and to the seat support, the at least one adjustable strap configured to limit the displacement of the seat support and maintain the seat support angle greater than a limit angle;

wherein the target mechanism comprises a target arm pivotally secured to the frame, the target arm having a first end that extends away from the seat and supports a target, and having a second end that extends under the seat; and wherein the second end of the target arm is configured to engage the strap such that when a sufficient force is applied to the target the target arm pivots transferring a force to the support pivot increasing the seat support angle to greater than 180 degrees, releasing the seat from the first position and displacing the user from the seat.

* * * * *